US006904910B2

(12) United States Patent
Christianson

(10) Patent No.: US 6,904,910 B2
(45) Date of Patent: Jun. 14, 2005

(54) FLIP TOP VALVE FOR DRY SNORKELS

(76) Inventor: Tony Christianson, 2007 Wawona Station, Yosemite, CA (US) 95389

( * ) Notice: Subject to any disclaimer, the term of this patent is extended or adjusted under 35 U.S.C. 154(b) by 0 days.

(21) Appl. No.: 10/717,391

(22) Filed: Nov. 17, 2003

(65) Prior Publication Data

US 2004/0099264 A1 May 27, 2004

Related U.S. Application Data

(60) Provisional application No. 60/428,034, filed on Nov. 20, 2002.

(51) Int. Cl.[7] ..... B63C 11/16; B63C 11/02

(52) U.S. Cl. ..... 128/201.11; 128/201.27; 405/186

(58) Field of Search ..... 128/200.24, 200.29, 128/201.11, 201.26, 201.12, 201.27, 201.28, 201.29, 206.29; 405/186, 187; 181/21, 22

(56) References Cited

U.S. PATENT DOCUMENTS 2,815,751 A * 12/1957 Ferraro ..... 137/410
3,345,984 A * 10/1967 Katehis ..... 128/201.11
5,524,611 A * 6/1996 Fu ..... 128/201.11
6,371,108 B1 * 4/2002 Christianson ..... 128/201.11
6,435,178 B1 * 8/2002 Lin ..... 128/201.27
6,516,797 B2 * 2/2003 Chen-Lieh ..... 128/201.11
6,655,378 B2 * 12/2003 Swetish ..... 128/201.11
6,679,253 B1 * 1/2004 Feng ..... 128/201.11
2002/0088459 A1 * 7/2002 Hsu ..... 128/201.11

* cited by examiner

*Primary Examiner*—Henry Bennett
*Assistant Examiner*—Teena Mitchell

(57) ABSTRACT

The instant invention is a valve mounted on the above water end of a skin diving snorkel. The valve's opening is in-line with the snorkel's longitudinal axis, thereby providing a substantially straight and unrestricted respiratory flow path. The valve consists of a soft diaphragm mounted on a compound linkage. The linkage is attached to the conduit adjacent the valve opening. A float activates the valve linkage whenever the snorkel starts to descend below the water surface. By the time the valve end of snorkel is underwater, the linkage has moved the diaphragm over and against the valve opening thereby preventing water from entering the snorkel. Conversely, when the valve end of the snorkel is above the water surface, the linkage moves the diaphragm to the side of the snorkel, completely away from the opening and out of the respiratory flow path.

18 Claims, 4 Drawing Sheets

FLIP TOP VALVE FOR DRY SNORKELS

RELATED PROVISIONAL APPLICATIONS AND DISCLOSURE DOCUMENTS

The instant invention is related to Provisional Application No. 60/428,034 titled "Flip top valve for dry snorkels" filed by the applicant Nov. 20, 2002; and Disclosure Document No. 534,494 titled "Flip top valve for dry snorkels" dated Jul. 10, 2003.

BACKGROUND OF THE INVENTION

1. Field of the Invention

The present invention is generally related to snorkels used by skin divers and swimmers. More particularly, this invention is concerned with preventing water from entering and flooding a snorkel.

2. Description of the Prior Art

Skin divers and swimmers use the snorkel as a means to breathe while swimming face down on the water surface. The snorkel functions as a conduit between the diver's mouth and the overhead air. Typically, the open end of the snorkel conduit extends a short distance above the water surface. Occasionally, due to swimming movements or wave action, small amounts of water flow or splash into the open end of the snorkel and partially floods the conduit. An experienced skin diver can sense when water enters the snorkel and responds by immediately stopping inhalation. Respiration is resumed after the snorkel has been purged of water. Inexperienced skin divers find occasional flooding especially troublesome because, undetected, water can be inhaled resulting in coughing and extreme discomfort.

Water will also flood the snorkel when the swimmer deliberately dives below the water surface. The snorkel conduit will be completely flooded with water when the swimmer returns to the surface. When the open end of the snorkel is again above the water surface, the flooded conduit is purged for respiration by exhaling an explosive blast of air into the mouthpiece.

Surface tension forms the purging blast of air into a bubble that spans the cross section of the snorkel conduit. Pressure within the bubble expands the bubble toward the open end of the conduit. As the leading surface of the bubble moves away from the mouthpiece, the bulk of the water within the conduit is pushed ahead of the bubble and out the open end.

The purging bubble of air will slip past water that adheres to the inside surface of the conduit. After the purging air bubble is spent, residual water will flow down the inside surface toward the mouthpiece. Also, water which splashes into the open end of the snorkel conduit due to swimming movements or wave action will typically strike and adhere to the inside surface of the conduit and thereafter flow toward the mouthpiece. Water accumulates at the lowermost portion of the snorkel conduit, typically adjacent the mouthpiece, and can soon obstruct the conduit. Unless the conduit is completely blocked, a slow and cautious inhalation is possible after which another purging exhalation can be made.

The respiratory effort needed to purge a snorkel is significant. Many skin divers and swimmers lack the respiratory strength needed to completely purge a flooded snorkel with a single exhalation, and must repeat the purging procedure several times. Also, water will sometimes enter the snorkel just as the swimmer has completed an exhalation, leaving very little air in the lungs to satisfactorily complete a purge.

As a consequence of the difficulties typically encountered by a skin diver or swimmer when trying to purge a flooded snorkel, a number of inventions have been proposed to protect the snorkel opening with devices that prevent water from entering the conduit, even when the swimmer dives underwater.

U.S. Pat. No. 2,317,236 titled Breathing Apparatus for Swimmers, issued to C. H. Wileri, et al, on Apr. 20, 1943, teaches an inverted opening with a caged buoyant ball arranged to block the above water end of the snorkel whenever water starts to enter. Such inverted ball valves are bulky, tend to snag, often fail to seal completely and, also, significantly increase respiratory effort. Although once popular, such devices are now considered unreliable and obsolete.

U.S. Pat. No. 4,071,024 titled Snorkel, issued to Max A. Blanc on Jan. 31, 1978, teaches an air-entrapping cap which is mounted on the above water opening of the snorkel. A tortuous passage in the cap retards water flow into the snorkel. Although such a cap is somewhat effective in blocking the occasional splash of surface water into the snorkel, it also retards expulsion of water that enters the snorkel during a dive below the water surface. The significant increase in respiratory and purging effort limits its utility and subsequent popularity.

U.S. Pat. No. 4,805,610 titled Swimmer's Snorkel, issued to Howard Hunt on Feb. 21, 1909, teaches a buoyant cap attached to an internal non-buoyant ball valve which is arranged to block the snorkel opening whenever water covers the cap. As with the valve of Wilen, the Hunt valve is bulky, tends to snag, and does not reliably prevent water from entering the snorkel.

U.S. Pat. No. 5,117,817 titled Vertical Co-Axial Multi-Tubular Diving Snorkel, issued to Hsin-Nan Lin on Jun. 2, 1992 teacher an annular float arrangement which blocks the above water end of the snorkel whenever water starts to enter. To assist in purging, the Lin snorkel also teaches a secondary purge tube within the breathing conduit. The Hoin-Nan Lin snorkel is an improvement over Wiler. However, the valve arrangement of the Hsin-Nan Lin snorkel significantly increases respiratory effort, and if water somehow gets into the snorkel, for example through the mouthpiece, that water is difficult to expel.

Somewhat similar to Blanc, U.S. Pat. No. 5,199,422 titled Modular snorkel, issued to Stan Rasocha on Apr. 6, 1995, teaches an exhaust valve mounted on a cap that covers the upper end of the snorkel. The cap restricts the entry of splashed water into the snorkel. The exhaust valve on the cap permits the direct expulsion of water from within the snorkel during a purging exhalation. Although Rasocha's snorkel is an improvement over Blanc, it nevertheless permits water to flood the snorkel when the swimmer dives below the surface.

U.S. Pat. No. 5,960,791 titled Dry Snorkel, issued to Carl Winefordner and Frank Hermansen on Oct. 5, 1999 teaches a snorkel having an upper opening directed to the side of the snorkel tube. A diaphragm carried on the end of a short buoyant arm serves as a valve that can close the upper opening and thereby keep water from entering the snorkel. The arm pivots at its opposite end so that the diaphragm can swing toward or away from the snorkel opening. Normally, the weight of the arm moves the diaphragm away from the opening. When the arm is submerged, the arm's buoyancy will cause the diaphragm to move against the snorkel opening. As lone as the arm is underwater, the snorkel opening will be closed. A cage protectively covers the arm and diaphragm assembly. The Winefordner and Hermansen snorkel requires that respiratory flow first pass through the cage openings and then abruptly turn 90 degrees through the side opening of the snorkel. Although adequate for casual or novice swimmers, the flow restriction caused by the 90 degree turn and interference by the relatively narrow openings in the protective cage, limits performance and the snorkel is not considered satisfactory for use by experienced snorkelers.

The applicant addressed many of the problems of the prior art by the teaching of U.S. Pat. No. 6,571,108 titled Dryest Snorkel, which issued to the applicant on Apr. 16, 2002. The applicant's patent teaches a buoyant chamber, separate from the conduit, which surrounds and is coaxial with the conduit above water end. A lower opening in the chamber is joined to the conduit by a convoluted diaphragm. The convoluted diaphragm provides a flexible and watertight barrier that enables the chamber to be easily buoyed a short distance upward, guided by the snorkel conduit. The conduit's open end protrudes loosely through an upper opening in the chamber. The conduit open end carries a flexible circular diaphragm that, when it makes contact with the upper opening of the buoyed chamber, serves as a check valve allowing exhalation flow from the conduit to ambient, but blocks the flow of water into the snorkel. In addition, an optional purge valve adjacent the conduit underwater end also allows flow from the conduit to ambient, but not in the reverse direction. The check valve remains closed as lone as the chamber is underwater. When the chamber is above water, its weight causes the chamber to drop down, opening the valve. Respiratory flow moves through the annular opening between the diaphragm and the upper opening of the chamber. Although the annular opening is relatively large, some resistance to respiratory flow is introduced, making the snorkel less than perfect for use by experienced snorkelers.

In view of the foregoing factors, conditions and problems that are characteristic of the prior art, the instant invention was conceived. It is the object of the instant invention to provide a snorkel top valve that reliably prevents water from entering the open end of a submerged snorkel, but does not in any way interfere with respiratory flow when the valve is open.

SUMMARY OF THE INVENTION

The instant invention is a valve for the top end of skin diving snorkels having a conduit with an open end above the water surface, and an underwater end that terminates in a mouthpiece. The mouthpiece provides a flow path between the conduit and the interior of the diver's mouth. The conduit's above water opening is in-line with the conduit's longitudinal axis, thereby providing a substantially straight and unrestricted respiratory flow path. The top valve consists of a flexible diaphragm mounted on a compound linkage. The linkage is attached to the conduit adjacent the top opening. A buoyant component activates the valve linkage whenever the snorkel starts to descend below the water surface. By the time the open end of snorkel is underwater, the linkage has moved the diaphragm over and against the top opening thereby preventing water from entering the conduit. Conversely, when the top of the snorkel is above the water surface, the diaphragm is moved to the side of the conduit, completely away from the top opening and out of the respiratory flow path.

DESCRIPTION OF THE DRAWINGS

A detailed description of the invention is made with reference to the accompanying drawings wherein like numerals designate corresponding parts in the several Figures.

DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention.

Figure 1:
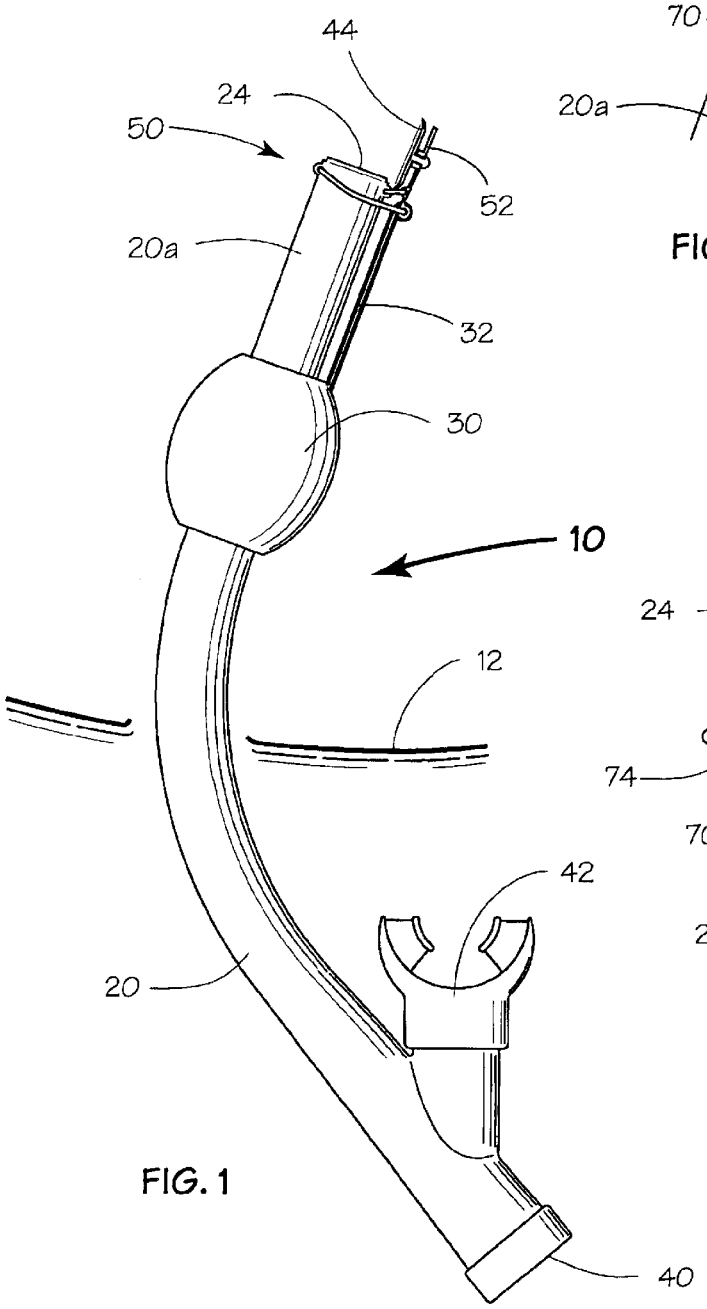
FIG. 1 is a side view of a snorkel having a top valve that has been constructed in accordance with the principles of the instant invention.

Referring to FIG. 1, snorkel 10 is pictured in the approximate position of use by a diver swimming face down on water surface 12. (For clarity, the diver is not shown in the FIGS.) The words "upper" and "lower" or "above the water surface" and "below the water surface," or the like, are made with reference to the orientation of snorkel 10 as shown in FIG. 1.

Snorkel 10 includes conduit 20 having upper end 20*a* that extend into the air above water surface 12. The lower end of conduit 20 is closed by purge valve 40. Purge valve 40 is arranged to allow fluid, for example water or saliva, to flow freely from conduit 20 to ambient. Although the preferred configuration includes purge valve 40, the instant invention can be incorporated on snorkels that do not include purge valve 40 by terminating the underwater end of conduit 20 at mouthpiece 42.

Purge valve 40 is, typically, a flexible diaphragm of a resilient material, for example silicon elastomer or the like, which is restrained in such a way that it can selectively flex under slight pressure to allow flow in one direction only. Reverse pressure forces the diaphragm to seal closed. Consequently, purge valve 40 will prevent the reverse flow of water from ambient into conduit 20.

Mouthpiece 42, above purge valve 40, branches from the side of conduit 20. Mouthpiece 42 is adapted to be held by the mouth of the diver and provides a flow path from conduit 20 to the interior of the mouth Conduit 20 is constructed of a rigid or semi-rigid material, for example, acrylic or vinyl plastic or the like. Conduit 20 is configured to approximately follow the curvature of the diver's head. The upper portion of conduit 20 smoothly curves to place upper end 20*a* approximately over the center of the head.

Providing a substantially smooth flow path that is free of abrupt changes in path direction facilitates respiration and purging. While not so limited, the curvature of conduit 20 may, for example, follow an elliptical path around the diver's head. Alternately, the upper portion of conduit 20 can be straight.

Figure 3:
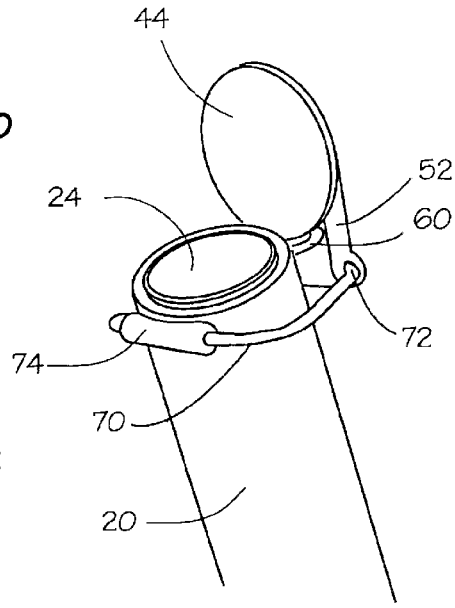
FIG. 3 is a close-up oblique view of the open valve of FIG. 1.

As best seen in FIG. 3, the upper portion of conduit 20 terminates at opening 24. Opening 24 is directly in-line with the conduit's longitudinal axis, thereby providing a substantially straight and unrestricted respiratory flow path to ambient.

Figure 2:
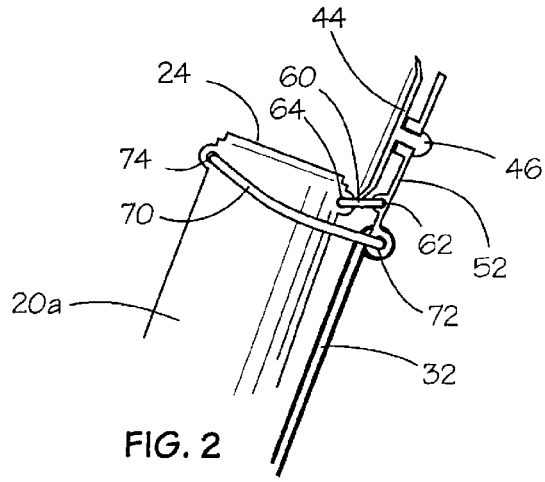
FIG. 2 is a close-up side view of the open valve of FIG. 1.
Figure 7:
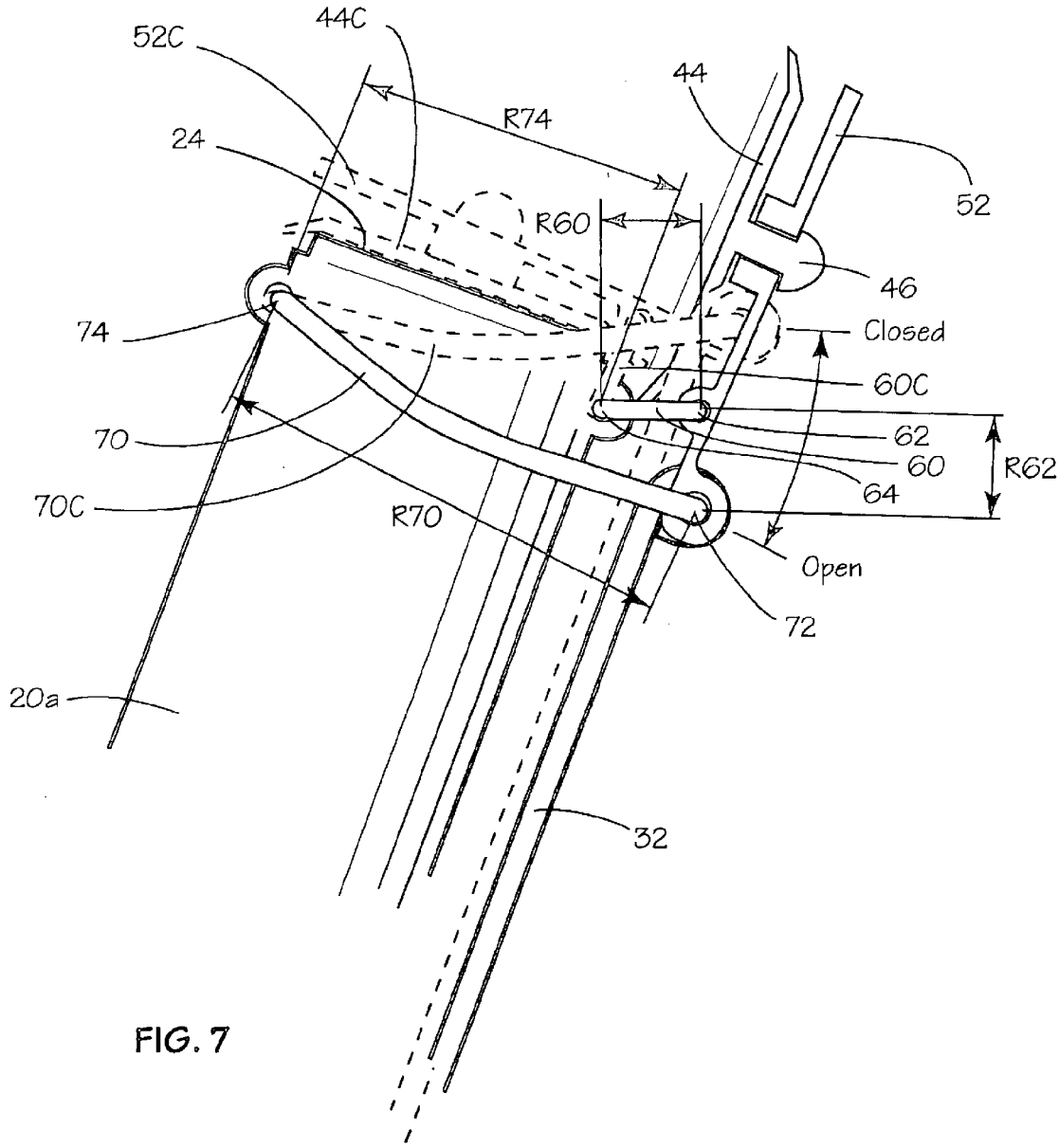
FIG. 7 is another close-up side view similar to FIG. 2.

Referring to FIGS. 2 and 7, valve assembly 50 is mounted on conduit 20 adjacent opening 24. Valve assembly 50 consists of a compound linkage that moves diaphragm 44 from an open position (shown by FIG. 2) to a closed position (shown by FIG. 5), and vice-versa. When diaphragm 44 is at the open position, it is located to the side of conduit 20, completely out of the respiratory flow path. When diaphragm 44 is at the closed position, it is located to provide a watertight covering of opening 24.

Diaphragm 44 is loosely mounted on arm 52 by tab 46. The movement of arm 52 is guided by the compound action of short link 60 and long link 70. One end of short link 60 is joined to arm 52 by pivot 62. The other end of short link 60 is joined to one side of snorkel opening 24 by pivot 64. Similarly, one end of long link 70 is joined to arm 52 by pivot 72; and the other end of long link 70 is joined to the opposite side of snorkel opening 24 by pivot 74.

The lengths of links 60 and 70; and the relative positions of pivots 62, 64, 72 and 74 are chosen to form a quadrilateral linkage assembly that moves diaphragm 44 from the open to the closed positions, and vice-versa. Referring to FIG. 7, link 60 is distance R60 long. Link 70 is distance R70 long. Pivots 62 and 72 are distance R62 apart. Pivots 64 and 74 are distance R74 apart. R60, R70, R62 and R74 form a four-sided polygon.

Figure 5:
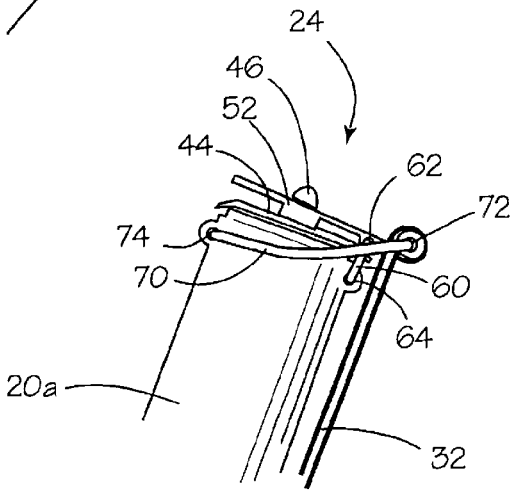
FIG. 5 is a close-up side view of the closed valve of FIG. 4.

The dimensions of R60, R70, R62 and R74; and the locations of pivots 62 and 72 on arm 52; and the locations of pivots 64 and 74 on conduit 20; are carefully chosen so that assembly 50 will either hold diaphragm 44 to the side of conduit 20 out of the respiratory flow path as shown by FIG. 2 (the "open" position), or place diaphragm 44 over and against opening 24 as shown by FIG. 5 (the "closed" position). Furthermore, the dimensions and locations are chosen so that valve assembly 50 is stable only when at either the fully open or completely closed positions.

Referring to FIG. 7, links 60 and 70, diaphragm 44, and arm 52, are shown in the open position as solid lines; and in the closed position as dashed lines identified 60C, 70C, 44C ad 52C respectively. The movement of link 70 between the open and closed positions is depicted by the double arrowed arc identified "Open-Closed".

While not so limited, empirical studies have determined that R74 should be equivalent to the outside diameter of conduit 20. The ratio of R60, R70, and R62 to R74 should be approximately 0.3 to 1.4 to 0.3 to 1. In addition, links 60 and 70 should be nearly parallel when valve assembly 50 is at the open position (see FIG. 7).

Valve assembly 50 moves in response to the movement of float 30. The movement of float 30 is transmitted to valve assembly 50 by rod 32. One end of rod 32 is firmly joined to float 30. The other end of rod 32 is pivotally joined with pivot 72 of link 70 (best seen in FIG. 6).

Figure 4:
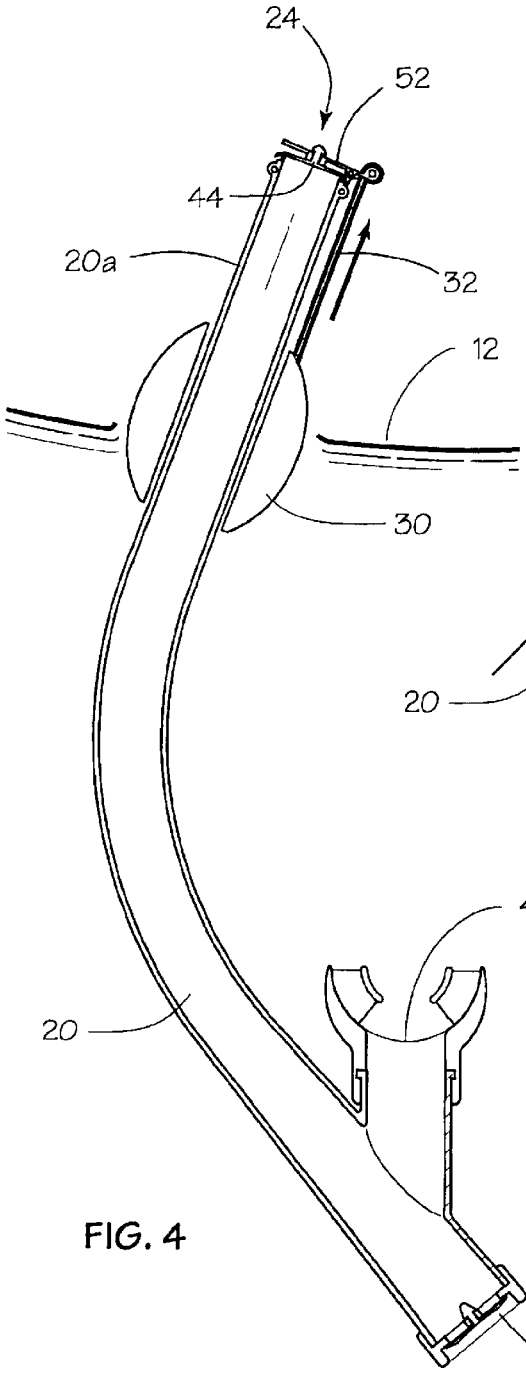
FIG. 4 is a longitudinal sectional side view of the snorkel of FIG. 1 shown with the valve closed.

When float 30 is not in the water, the weight of float 30 pulls rod 32 downward thereby pulling arm 52 to the open position. When float 30 is in the water, the resultant buoyant force pushes rod 32 upward thereby pushing arm 52 to the closed position. The upward pointing arrow in FIG. 4 depicts the direction of closing movement of float 30 and rod 32.

Diaphragm 44 is, typically, a flexible diaphragm of a resilient material, for example silicon elastomer or the like. Diaphragm 44 is loosely mounted on arm 52 by tab 46. The loose mounting enables diaphragm 44 to flex and tilt as needed to make a watertight seal against the periphery of opening 24.

Figure 6:
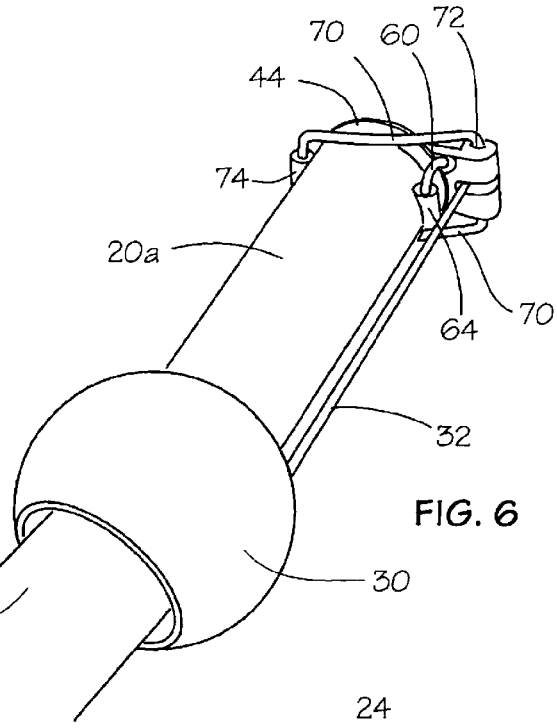
FIG. 6 is an upward-looking oblique view of the closed valve of FIG. 4.

Float 30 is typically a low-density material, for example closed-cellular ridged foam or the like. Alternately, float 30 can be hollow. As best seen in FIG. 6, float 30 loosely surrounds and is thereby guided by conduit 20. Although a spherical external surface is pictured, float 30 can be cylindrical, elliptical, or any other useful shape. By appropriately adjusting the length of rod 32, float 30 can be located anywhere along conduit 20 between valve 50 and mouthpiece 42. When float 30 is located relatively close to valve 50, the closing response of valve 50 is delayed until almost all of conduit 20 is underwater. When float 30 is located relatively close to mouthpiece 42, the closing response of valve 50 will be very sensitive to water movement up conduit 20. The ideal location of float 30 is a compromise so that valve 50 is fully closed by the time conduit 20 is completely underwater, but not so sensitive as to be inadvertently closing due to wave action or swimming movement.

Arm 52 is typically fabricated by molding a rigid material, for example polycarbonate plastic. Links 60 and 70 are typically fabricated by bending wire, for example, 316 stainless steel wire. Links 60 and 70 can also be fabricated by stamping and bending thin sheet metal stock, for example, 316 stainless steel sheet. Alternately, links 60 and 70 can be fabricated by molding a rigid material, for example polycarbonate plastic.

Referring to FIGS. 1 and 2, when float 50 is entirely out of the water, the weight of the float has pulled rod 32, and consequently pivot 72, downward. Conversely, Referring to FIGS. 4 and 5, when water travels up snorkel 10 and starts to submerge float 30, for example, due to wave action or a deliberate diving action by the swimmer, buoyant force will overwhelm the weight of float 30 and the weight of valve assembly 50, causing pivot 72 to move upward, which causes arm 52 to drop diaphragm 44 over opening 24. Short link 60 serves to provide the sideways and dropping movement of arm 52 and, thereby, diaphragm 44. Advantageously, the volume of float 30 is chosen so that sufficient buoyant force is available to close valve 50. However, an overly large float 30 will be bulky and unwieldy. Consequently, the size of float 30 is a compromise that provides adequate buoyancy but not excess bulk.

When float 30 is partially or completely submerged, buoyant force will cause diaphragm 44 to cover opening 24, thereby preventing water from entering conduit 20. If opening 24 is closed while the swimmer is inhaling, inhalation flow will be blocked to prevent the undesirable entry of water into conduit 20. If opening 24 is closed while the swimmer is exhaling, the pressure of exhalation will flex diaphragm 44 outward thereby allowing the exhaled gases to continue to escape. Any subsequent inhalation will be blocked until float 30 is once again above the water.

If the swimmer removes mouthpiece 42 from the mouth while in the water, for example to talk, snorkel 10 will often be at least partially flooded when the swimmer returns mouthpiece 42 to the mouth for additional use. Similarly, if the swimmer enters the water without mouthpiece 42 already in the mouth, snorkel 10 will often be at least partially flooded when the swimmer first puts mouthpiece 42 in the mouth. In addition, saliva from the mouth can drain into conduit 20 and accumulate below mouthpiece 42.

Water and saliva in conduit 20 are purged by forcefully exhaling air into mouthpiece 42. Surface tension forms the exhaled air into a bubble that expands upward in conduit 20. As the leading surface of the bubble moves away from mouthpiece 42, the bulk of the water within conduit 20 is pushed ahead of the bubble and out opening 24. This purging action is facilitated by the instant invention because opening 24 is substantially inline with the longitudinal axis of conduit 20.

In the event that float 30 moves upward (due, for example, to wave action) during the purging exhalation, diaphragm 44 will close, but the expulsion of water will continue because the internal pressure will flex the diaphragm outward, away from opening 24, and allow the water inside conduit 20 to escape. Consequently, inventive snorkel 10 does not prevent a purging exhalation even when conduit upper end 20*a* is nearly or completely underwater.

When optional purge valve 40 is provided, a forceful exhalation will also expand downward, forcing fluid below mouthpiece 42 to flow to ambient through purge valve 40. The outflow of water will flex purge valve 40 outward. Consequently, a purging exhalation forces water within conduit 20 to be cleared both above and below mouthpiece 42.

The volume of the portion of conduit 20 between mouthpiece 42 and purge valve 40 is advantageously sized to hold, away from the respiratory flow path, saliva or any residual water that remains after a purging exhalation. Empirical studies have determined that a volume equivalent to ten percent (10%) of the snorkel's total internal volume is sufficient for this purpose.

When a swimmer dives below the water surface and snorkel 10 is completely submerged, float 30 will have moved upward, thereby causing diaphragm 44 to cover opening 24. As the diver continues to swim below the water surface and looks around, the orientation of snorkel 10 will not necessarily remain upright. Head movements will change the orientation of snorkel 10 relative to the water surface. For example, snorkel 10 will be completely inverted relative to the water surface when the swimmer is looking directly upward.

It is crucial that when underwater the net force acting on diaphragm 44 be directed to hold diaphragm 44 at the closed position, no matter what the orientation of snorkel 10 when the snorkel is completely underwater When a swimmer first dives underwater, buoyancy provides the force that closes valve assembly 50. But when snorkel 10 is fully submerged, ambient pressure will also act to hold diaphragm 44 firmly against opening 24. Underwater, the pressure inside snorkel 10 can never be greater than ambient because excess pressure will be vented through the check valve action of diaphragm 44 or, when snorkel 10 is inverted, purge valve 40. The ambient pressure at the depth of diaphragm 44, or purge valve 40 when snorkel 10 is inverted, will determine the maximum pressure inside conduit 20. As the swimmer dives deeper, ambient pressure against the lungs will compress the lungs thereby maintaining the respiratory tract at or near ambient pressure. Although instinctively the swimmer will stop breathing when underwater, and may plug mouthpiece 42 with the tongue, the pressure of the respiratory tract will involuntarily bleed through mouthpiece 42 into conduit 20. However, unless the swimmer continuously exhales into snorkel 10 as the depth increases, the pressure inside snorkel 10 will be somewhat less than ambient. The slightly lower pressure inside conduit 20 with respect to ambient pressure is used by the instant invention to keep diaphragm 44 firmly sealed against opening 24, no matter what the orientation of snorkel 10.

Furthermore, when snorkel 10 is inverted, the buoyant force will be working to move float 30 away from the closed position, but the gravitational force and the differential pressure force across diaphragm 44 will be working to hold diaphragm 44 in the closed position. For diaphragm 44 to remain at the closed position even when snorkel 10 is inverted, the net pressure force against the diaphragm plus gravitational force must be greater than the buoyant force from float 30. The preferred configuration includes purge valve 40 because purge valve 40 provides the benefit of maintaining the pressure inside conduit 20 less than ambient when snorkel 10 is inverted underwater, thereby maximizing the pressure force holding diaphragm 44 closed.

Figure 8:
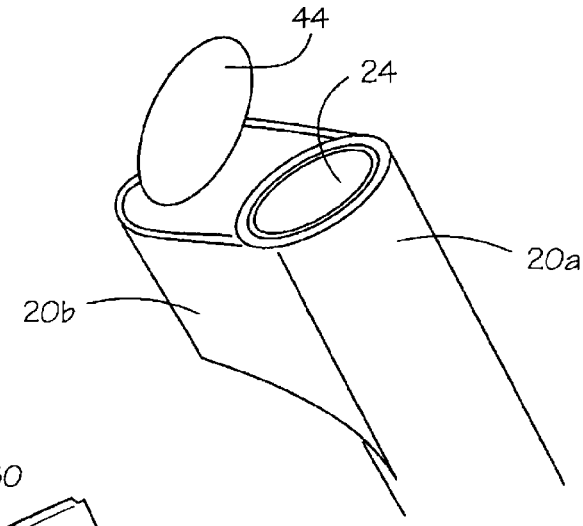
FIG. 8 is an oblique view showing an alternate configuration.

It is advantageous to cover valve assembly 50 in order to prevent external objects or material, for example seaweed, from snagging on or otherwise interfere with the function of linkages 60 and 70, arm 52, and diaphragm 44. Any such cover must be open at the top so that it will not interfere with respiratory or purging flow. Referring to FIG. 8, cover 20*b* is shown as an example of a means to protect the valve components and also streamline the top of conduit 20. Cover 20*b* is shown protruding from the side of conduit 20, but other configurations can be conceived that are appropriate, for example a ring that completely surrounds valve 50 and conduit end 20*a*, and possibly float 30.

Figure 9:
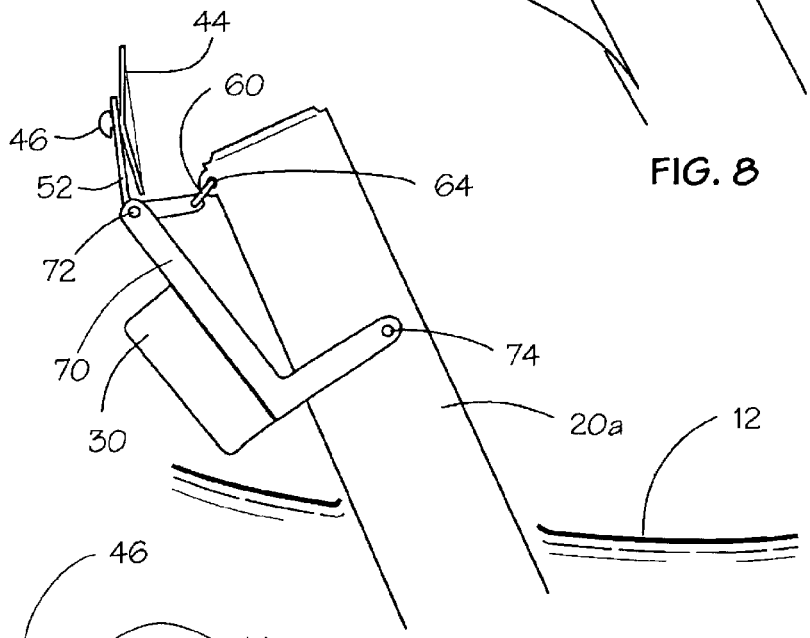
FIG. 9 is a close-up side view of another alternate configuration showing the valve open.
Figure 10:
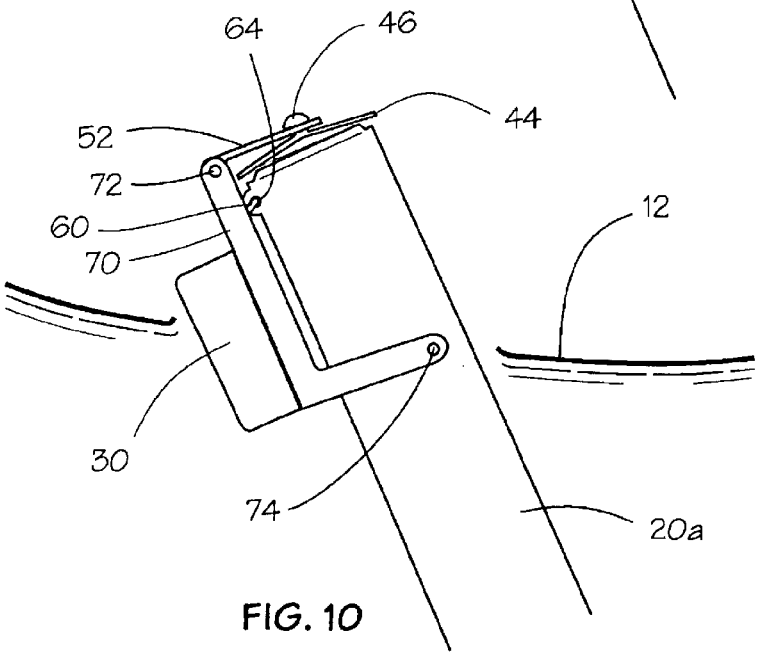
FIG. 10 is a close-up side view of the alternate configuration of FIG. 9 showing the valve closed.

FIGS. 9 and 10 show an alternate configuration, open and closed respectively, of the instant invention in which float 30 is directly attached to and is carried by link 70. To accommodate the placement of float 30 on link 70, pivot 74 must be located as shown in FIGS. 9 and 10. As with the preferred configuration of FIG. 1, the dimensions of the four-sided polygon formed by the various links must be chosen so that diaphragm 44 moves completely out of the respiratory flow path when float 30 is above the water surface.

Other variations on the diameter, cross-section shape and radius of curvature of conduit 20; size and shape of float 30; size, shape and location of valve assembly 50 on conduit 20; size and shape of cover 20*b*; and various methods to adjust the mouthpiece location and orientation relative to the conduit, are contemplated.

It is understood that those skilled in the art may conceive of modification and/or changes to the invention described above. Any such modifications or changes that fall within the purview of the description are intended to be included therein as well. This description is intended to be illustrative and is not intended to be limiting. The scope of the invention is limited only by the scope of the claims appended hereto.

I claim:

1. A snorkel device comprising:

a conduit adapted to extend above a water surface;

said conduit having a longitudinal axis;

said conduit having first and second ends thereof;

said conduit first end adapted to admit air into said conduit when said conduit first end is above the water surface;

said ambient air flows unrestricted into said conduit first end along a flow path that is substantially inline with the longitudinal axis of said conduit;

mouthpiece joined to said conduit second end for communicating fluid flow with said conduit;

linkage adjacent said conduit first end;

buoyant means for controlling movement of said linkage; and sealing means carried by said linkage, said sealing means substantially prevents the flow of ambient fluid into said conduit when at least a portion of said buoyant means is underwater; said sealing means is moved by said linkage substantially out of the ambient air flow path when said buoyant means is above the water surface.

2. The snorkel device recited in claim 1 wherein:

said linkage is a compound linkage.

3. The snorkel device recited in claim 2 wherein:

said linkage forms a four-sided polygon.

4. The snorkel device recited in claim 1 wherein:

said buoyant means is a hollow float.

5. The snorkel device recited in claim 1 wherein:

said buoyant means is carried by said linkage.

6. The snorkel device recited in claim 1 including:

control means joining said buoyant means to said linkage.

7. The snorkel device recited in claim 1 wherein:

said buoyant means is a rigid material having less density than water.

8. The snorkel device recited in claim 1 wherein:

said sealing means includes a flexible diaphragm and adjacent seat arranged to selectively provide unidirectional fluid flow from said conduit first opening to ambient when said buoyant means is at least partially underwater.

9. The snorkel device recited in claim 8 wherein:

said flexible diaphragm is carried by said linkage; and said adjacent seat is carried by said conduit first end.

10. The snorkel device recited in claim 1 including:

second valve means adjacent said conduit second end, said second valve, means arranged to selectively provide unidirectional flow from said conduit to ambient.

11. The snorkel device recited in claim 1 wherein:

said buoyant means is guided by at least a portion of said conduit.

12. A snorkel device for swimmers comprising:

a conduit having a longitudinal axis, and first and second open ends thereof;

said conduit first open end adapted to admit ambient fluid into said conduit substantially in line with said longitudinal axis thereby providing a substantially straight and unrestricted flow path;

mouthpiece joined to said conduit second open end for communicating fluid flow with said conduit;

buoyant means adapted to move relative to said conduit; and sealing means adapted to provide unidirectional flow from said conduit first opening to ambient when said buoyant means is at least partially underwater; said sealing means adapted to be not in the ambient fluid flow path when said buoyant means is out of the water.

13. The snorkel device recited in claim 12 including:

linkage adjacent said conduit first end, said linkage adapted to carry said sealing means.

14. The snorkel device recited in claim 13 wherein:

movement of said linkage is controlled by said buoyant means.

15. A snorkel device adapted to extend above the water surface when carried by a swimmer; said snorkel device comprising:

a conduit having first and second ends thereof;

said conduit first end adapted to admit ambient fluid into said conduit;

mouthpiece joined to said conduit second end for communicating fluid flow with said conduit;

sealing means, having a closed position that blocks the entry of ambient fluid into said conduit first end; said sealing means having an open position that does not substantially interfere with the flow of fluid into and out of said conduit first end;

control means; and linkage operated by aid control means; said linkage adapted to move said sealing means from the open position to the closed position when said control means is at least partially underwater, and from the closed position to the open position when said control means is out of the water.

16. The snorkel device recited in claim 15 wherein:

gravitational and buoyant forces act on said control means;

the force due to gravity acting on said control means, and water pressure against said sealing means define a combined force;

said combined force is greater than the buoyant force when said snorkel device is inverted underwater.

17. The snorkel device recited in claim 15 including:

second valve means adjacent said conduit second open end, said second valve means arranged to selectively provide unidirectional flow from said conduit to ambient.

18. The snorkel device recited in claim 15 including:

protective means covering said linkage ad said sealing means, said protective means does not substantially interfere with the flow of fluid into and out of said conduit first end.

* * * * *